US006569221B2

(12) United States Patent
Berglund

(10) Patent No.: US 6,569,221 B2
(45) Date of Patent: May 27, 2003

(54) FECRAL ALLOY

(75) Inventor: Roger Berglund, Västerås (SE)

(73) Assignee: Sandvik Aktiebolag, Sandviken (SE)

( * ) Notice: Subject to any disclaimer, the term of this patent is extended or adjusted under 35 U.S.C. 154(b) by 0 days.

(21) Appl. No.: 09/941,561

(22) Filed: Aug. 30, 2001

(65) Prior Publication Data

US 2002/0051727 A1 May 2, 2002

(30) Foreign Application Priority Data

Sep. 4, 2000 (SE) ..... 0003139

(51) Int. Cl.[7] ..... C22C 38/18; C22C 38/06
(52) U.S. Cl. ..... 75/255; 75/246
(58) Field of Search ..... 75/255, 246; 420/62

(56) References Cited

U.S. PATENT DOCUMENTS 4,315,776 A * 2/1982 Pitler ..... 75/208 R
4,347,431 A 8/1982 Pearce et al.
5,045,404 A * 9/1991 Ohmura et al. ..... 420/40
5,426,084 A * 6/1995 Fukaya et al. ..... 420/40
5,480,608 A * 1/1996 Tsuda et al. ..... 420/40
5,578,265 A 11/1996 Ericson et al.

FOREIGN PATENT DOCUMENTS

| | | |
|---|---|---|
| DE | 199 28 842 A1 | 1/2001 |
| EP | 0 290 719 A1 | 11/1988 |
| SE | 467414 | 7/1992 |
| WO | 99/00526 | 1/1999 |

* cited by examiner

*Primary Examiner*—Deborah Yee
(74) *Attorney, Agent, or Firm*—Burns, Doane, Swecker & Mathis, LLP

(57) ABSTRACT

This invention relates to an alloy suitable for use in industrial and other heating applications, having a ferritic stainless steel alloy comprising, in weight %, less than 0.02% carbon; ≦0.5% silicon; ≦0.2% manganese; 10.0–40.0% chromium; ≦0.6% nickel; ≦0.01% copper; 2.0–10.0% aluminum; one or more of Sc, Y, La, Ce, Ti, Zr, Hf, V, Nb and Ta in an amount of 0.1–1.0; remainder iron and unavoidable impurities. A heating element of this alloy is provided. A diffusion furnace having such a heating element is also provided.

8 Claims, 2 Drawing Sheets

FECRAL ALLOY

FIELD OF THE INVENTION

The present invention relates to a ferritic stainless steel alloy. More specifically this invention relates to an alloy suitable for use in industrial and other heating applications, such as electric heating elements in diffusion furnaces for the production of semiconductors and similar applications having special demands regarding ultra low content of impurities, more specifically an ultra low content of copper.

DESCRIPTION OF THE RELATED ART

In the description of the background of the present invention that follows reference is made to certain structures and methods, however, such references should not necessarily be construed as an admission that these structures and methods qualify as prior art under the applicable statutory provisions. Applicant reserves the right to demonstrate that any of the referenced subject matter does not constitute prior art with regard to the present invention.

Heat treatment is a typical operation in many industries, for example in the manufacturing of semiconductor wafers. During such process semiconductor wafers are heated in furnaces to temperatures of 700° C. to 1250° C. in order to alter the properties or composition of the surface of said semiconductor wafers. For example, heat treatment in controlled gaseous atmosphere allows certain dopant elements to migrate into the structure of the semiconductor material. A controlled environment within a diffusion furnace brings about a predictable result. Problems can occur in the control of the environment within the diffusion furnace. Certain harmful impurities tend to be introduced into the furnace, for example, by diffusion of alloying elements or impurities from the heating elements. These impurities can then find their way into the semiconductor wafers. Adverse effects of those harmful impurities show a tendency to increase with time of use of the furnace/tube. This has been a problem for this kind of application for a long time (see, e.g.—U.S. Pat. No. 4,347,431).

It has been found that a yield for the production of special types of semiconductors is limited by Cu-contamination during the production of said semiconductor wafers. Copper has been identified as one of the most harmful impurities. Heating elements in the diffusion furnace have been identified as a source for this Cu-contamination during a long range of different tests.

One problem that occurs in connection with the measurement of contents of elements that usually occur as impurities in the manufacture of alloys used for heating elements, is that those low contents of elements and/or impurities can not be measured with a satisfying accuracy. Special test methods, as described in detail later, had to be used, even in order to show the advantages of the alloy of the present invention.

Ferritic stainless steel alloys, usually referred to as FeCrAl-alloys, are resistant to thermal cyclic oxidation at elevated temperatures and suitable for forming a protective oxide layer such as, i.e. an adherent layer/scale of aluminum on the surface of the alloy after heat treatment. This oxide layer/scale is considered to be one of the most stable protecting oxides/layers on the surface of an alloy of said type, having low oxidation rates at high temperatures and at the same time resist to cyclic thermal stress during long periods of time. It has been shown that this type of alloy can advantageously be used in applications such as for example exhaust emission control systems for the automotive industry, applications with high demands regarding resistance for high temperature induced corrosion, such as turbine rotors and industrial and other heating applications, such as electrical heating or resistance heating elements.

A limiting factor for the lifetime of this type of alloys is the content of aluminum. During the use of parts manufactured of these alloys and their exposure to cyclic thermal stress, the aluminum migrates to the surface, forms alumina and will be consumed after a certain period of time. It is known that a range of other elements, such as rare earth metals, have an effect on the rate of consumption of aluminum from the alloy and hence limits the lifetime.

Another limiting factor is the different rate of elongation between the oxide-layer and the surface of the alloy. The core alloy of, for example, a wire, expands its volume in a considerably higher amount than the oxide scale that covers this core. The oxide scale is hard and brittle and withstands the forces that core exerts until cracks in this scale and spallation of oxide scale occurs. These cracks will be sealed by newly formed oxide under said heating. This healing process of the oxide consumes the aluminum from the alloy core. This effect is a typical restriction for the use of said alloy for heating applications.

SUMMARY OF THE INVENTION

It is an object of the invention to provide an iron-chromium-aluminum alloy, a so-called FeCrAl alloy with for the use in industrial and other heating applications. More specifically for the use as electrical heating element in, for example, diffusion furnaces used in the electronics industry, i.e. in diffusion furnaces for the manufacture of semiconductor wafers for the use in applications with high demands to the purity of the semiconductors regarding the content of impurities, especially the content of copper.

Another object of the present invention is the considerable longer life time of the electric heating element, since the alloy of the invention appears to show lower Al depletion rate and smaller amount of elongation than known alloys for the above mentioned purpose.

According to one aspect, the present invention provides a ferritic stainless steel alloy comprising, in weight %, less than 0.02% carbon; ≦0.5% silicon; ≦0.2% manganese; 10.0–40.0% chromium; ≦0.6% nickel; ≦0.01% copper; 2.0–10.0% aluminum; one or more of Sc, Y, La, Ce, Ti, Zr, Hf, V, Nb and Ta in an amount of 0.1–1.0; remainder iron and unavoidable impurities.

According to another aspect, the present invention provides an electrical heating element containing, at least in part a ferritic stainless steel alloy comprising, in weight %, less than 0.02% carbon; ≦0.5% silicon; ≦0.2% manganese; 10.0–40.0% chromium; ≦0.6% nickel; ≦0.01% copper; 2.0–10.0% aluminum; one or more of Sc, Y, La, Ce, Ti, Zr, Hf, V, Nb and Ta in an amount of 0.1–1.0; remainder iron and unavoidable impurities.

According to yet another aspect, the present invention provides a diffusion furnace comprising a heating element formed from an alloy according to the principles of the present invention.

DETAILED DESCRIPTION OF THE INVENTION

Figure 1:
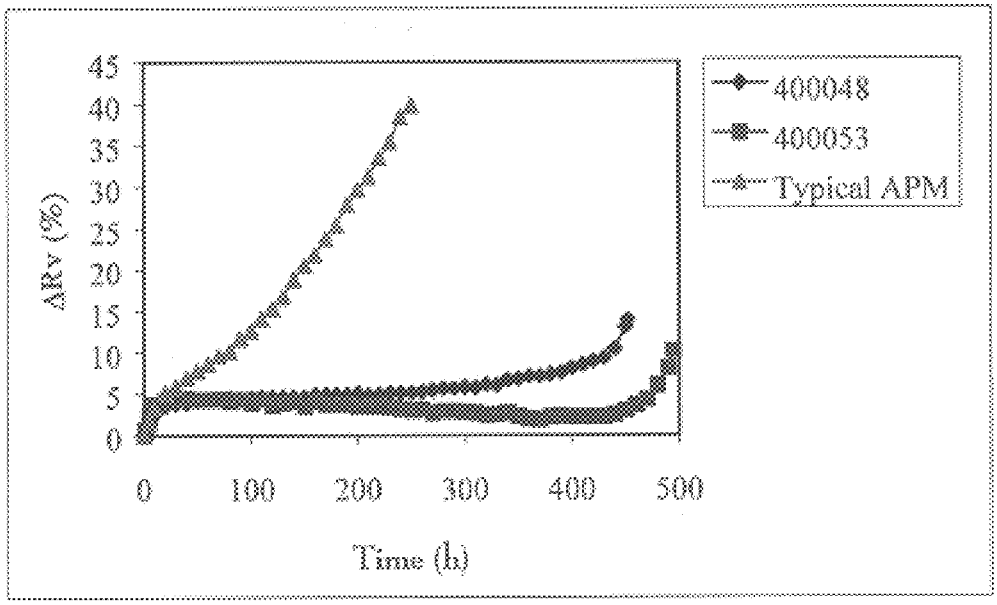
FIG. 1 shows Bash test results, relative change of hot resistance vs. time for two ultra low Cu containing alloy samples according to the invention compared with typical results for Kanthal APM alloy.
Figure 2:
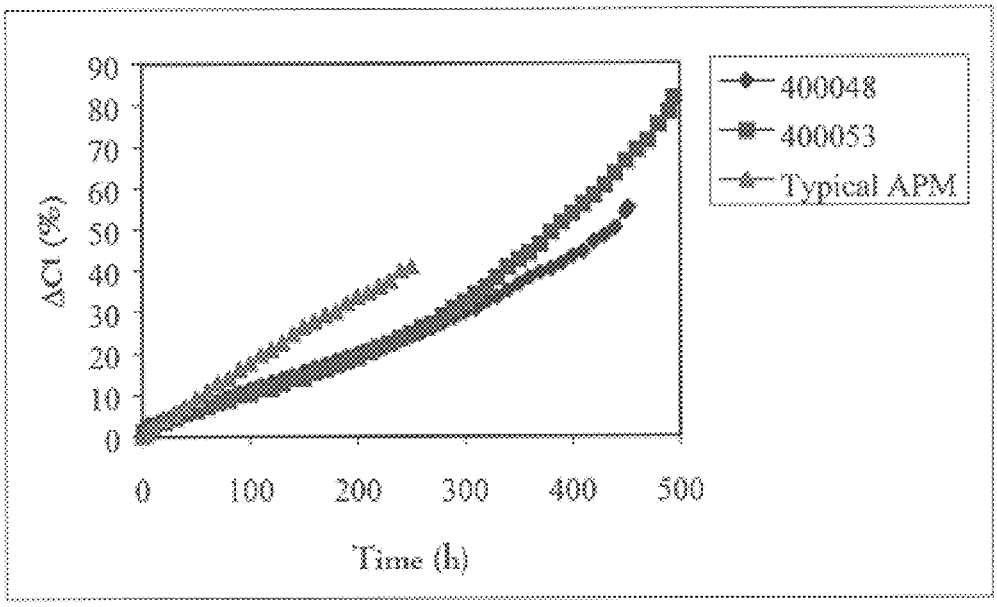
FIG. 2 shows Bash test results, relative change of ratio between hot and cold resistance ΔCt, plotted versus time for two ultra low Cu containing alloy samples according to the invention compared with typical results for Kanthal APM. The ΔCt value corresponds to the loss of Al from the sample due to oxidation.

The present invention provides a powder metallurgical FeCrAl alloy of above described type, that satisfies high demands on the purity of the alloy, i.e. an ultra low content of copper. Further, the invention provides an alloy with increased lifetime and drastically reduced Al depletion and elongation rate. The invention also provides a solution that prolongs the lifetime of the heating device and reduces the costs for the manufacturing process.

A ferritic FeCrAl-alloy according to the present invention contains usual quantities of chromium and aluminum, but contains special additions of silica, manganese, optionally rare earth metals in certain quantities, such as specifically described and quantified in Swedish Patent Publication No. 467,414, which is hereby incorporated by reference. The powder metallurgical alloy of this patent publication is known under its commercial designation Kanthal APM, hereinafter referred to as Kanthal APM and can be considered as a standard type alloy in this connection.

The chemical composition of the alloy of the invention is given below. The content of copper has been reduced to around 10% of the typical content of copper of known alloys used for electrical heating elements (compare Table 1). Besides the ultra low content of copper, the inventive alloy powder also provides reduced levels of Ni and Mn. The contents of other elements used are considered not having a negative effect considering the lifetime and the use of the manufactured semiconductors and are held in the same range as hitherto known.

Composition of a preferred alloy, all contents given in weight-%:

| | |
|---|---|
| C | less than 0.3 |
| Si | up to ≦0.5 |
| Mn | up to ≦0.2, preferably less than 0.1 |
| Cr | 8.0–40.0, preferably 15.0–25.0 |
| Ni | up to 0.2, preferably less than 0.1 |
| Cu | not more than 0.004 |
| Al | 2.0–10.0, preferably 3.0–8.0 |
| One or more of a group of other reactive elements, such as Sc, Y, La, Ce, Ti, Zr, Hf, V, Nb, Ta | 0.1–1.0 |
| N | less than 0.05 |
| Fe | balance |

Other Unavoidable Impurities

The tests were performed on two samples 400048 and 400053 of the alloy of the invention, compared to the commercial Kanthal APM alloy, which is a powder metallurgical alloy.

TABLE 1

Chemical composition of ultra low Cu containing alloy sample compared to Kanthal APM.

| | Si | Mn | Cr | Ni | Cu | Al |
|---|---|---|---|---|---|---|
| 400048 | 0.31 | 0.05 | 21.1 | 0.03 | 0.0026* | 5.48 |
| 400053 | 0.30 | 0.07 | 21.0 | 0.03 | 0.0035* | 5.74 |
| Typical APM | 0.29 | 0.09 | 21.0 | 0.17 | 0.029 | 5.76 |

*Analyzed with ICP-OES.

Description of the Testing Methods and Results

The normal analysis method, X-Ray Fluorescence Spectrometry (XRF), is not sensitive enough for analyzing contents of elements in the range of ppm. A special copper analysis is therefor made with Inductively Coupled Plasma Optical Emission Spectrometry (ICP-OES) in order to get a more reliable value for the copper content.

Bash Test

Life testing with the Bash method is a standard test for determination of oxidation resistance of heat resistant materials. The test is based on the standard ASTM B 78. Shortly described this includes, that a 0.70 mm wire sample is thermally cycled, 120 sec. on/120 sec. off, between room temperature and approx. 1265° C., until failure. The gradual change in hot and cold resistance of the sample is monitored during the test period. The time to failure is registered. The voltage is gradually adjusted during the test, to maintain a constant power on the sample.

Average life of Kanthal APM in the Bash test is around 260 h. The life of sample 400048 was 452 h. This means an increase with 74% compared with Kanthal APM.

Furnace Test

The furnace test is an internal, accelerated test used to evaluate oxidation life and elongation of FeCrAl resistance heating alloys used for industrial applications. In short described, a 4.00 mm wire is formed to a U-shaped element, welded to terminals and installed in a chamber furnace. The chamber furnace is heated by the sample to 900° C. and the sample temperature is cycled between 900° C. and 1300° C. by on/off regulation. Cycle time is 60 sec. on and 30 sec. off. Surface load is around 17 W/cm$^2$. Two times a week measurements of hot resistance, cold resistance and element length are made. During these measurements the samples are cooled to room temperature. Voltage is adjusted after each measurement to maintain a constant power to the sample. Test normally continues to sample failure.

At this moment the sample from batch 400053 reached 1250 h test time. The sample from batch 400048 reached a life of 1200 h, which is well above the average life for Kanthal APM, being around 900 h. This means an increase of at least 33% compared to Kanthal APM.

Figure 3:
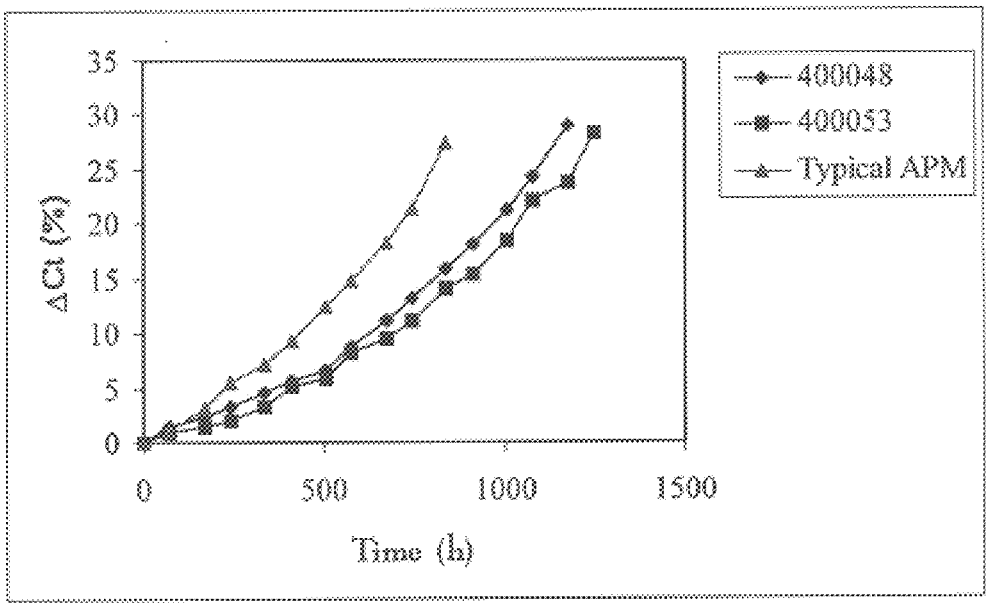
FIG. 3 shows results from Furnace test. Relative change of the ratio between hot and cold resistance plotted versus time for two ultra low Cu containing samples according to the invention compared with Kanthal APM, due to oxidation.
Figure 4:
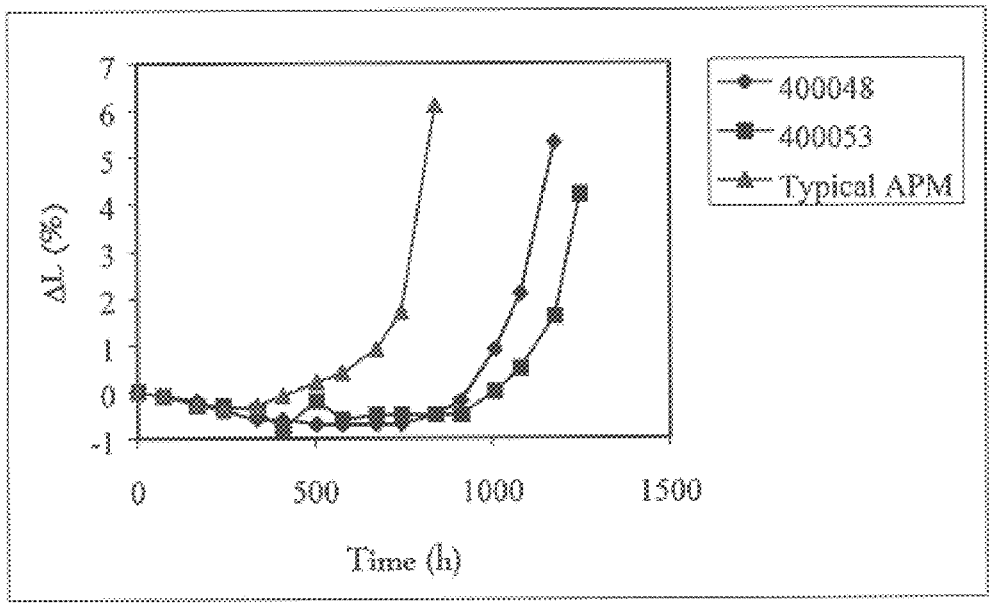
FIG. 4 shows the results from Furnace test. Relative change of the sample length plotted versus time for two samples with ultra low Cu content in the alloy according to the invention compared with typical results for standard Kanthal APM.

As in the Bash test, the rate of Al depletion as a bench mark for the lifetime in the Furnace test samples can be studied by plotting the relative change of Ct (=the ratio between hot and cold resistance.) versus time. In Table 2 and FIG. 3 the results for the two low Cu samples are shown compared to Kanthal APM results. The rate of Al depletion is clearly lower in the low Cu-content samples.

TABLE 2

Relative change of the ratio ΔCt vs. time for the samples according to the inventions compared with the standard Kanthal APM.

| | ΔCt | | |
|---|---|---|---|
| Time | 400048 | 400053 | Kanthal APM |
| 0 | 0 | 0 | 0 |
| 72 | 1.4 | 0.9 | 1.1 |
| 168 | 2.4 | 1.4 | 3.1 |
| 240 | 3.2 | 2 | 5.4 |
| 336 | 4.5 | 3.3 | 7.2 |
| 408 | 5.6 | 5.1 | 9.3 |
| 504 | 6.5 | 5.9 | 12.4 |
| 576 | 8.8 | 8.2 | 14.7 |
| 672 | 11.2 | 9.5 | 18.3 |
| 744 | 13.2 | 11.1 | 21.3 |
| 840 | 15.8 | 14 | 27.3 |
| 912 | 18.1 | 15.3 | |
| 1008 | 21.2 | 18.5 | |
| 1080 | 24.2 | 22.1 | |
| 1176 | 28.9 | 23.7 | |
| 1248 | | 28.2 | |

The elongation of the sample is influenced by two main factors. The depletion of Al from the alloy due to oxidation causes a volume decrease of the sample, visible as a decrease of the sample length in the early stage of the test. As the thickness and strength of the oxide scale increases, the thermal cycling stress will cause elongation of the sample. In the first stage the curve for the low Cu alloy seems to have a similar shape as the curve for Kanthal APM, but the elongation starts later. First after at least 38% longer test time the first sample (400048) shows the same ratio ΔCt as the standard Kanthal APM.

Cu-emission Measurements

A coil of thin wire is heated inside a clean quartz tube. The inner wall of the tube is then washed with acid and the Content of copper in the acid is determined with the ICP-OEC analyzer. The test shows a reduction in copper emission of at least 8% for a sample not heated in advance and at least 25% for a sample after pre-oxidization, both compared with standard Kanthal APM.

Thus, the improvements in the oxidation life tests with the ultra low copper content alloy are rather dramatic. The ultra low content of copper results in a less spalling oxide, which explains the lower Al-consumption rate.

The low elongation of the wire can also be connected to the properties of the oxide/scale. If the oxide can withstand the stress build-up during thermal cycling without spalling or formation of micro-defects and withstand the intrinsic stress build-up, a major mechanism behind elongation due to thermal cycling can be eliminated.

The improved properties of the oxide/scale can be obtained by improved adherence between the oxide/scale and the metal or by improved mechanical properties of the oxide itself.

While the present invention has been described by reference to the above-mentioned embodiments, certain modifications and variations will be evident to those of ordinary skill in the art. Therefore, the present invention is to limited only by the scope and spirit of the appended claims.

What is claimed is:

1. A powder metallurgical FeCrAl alloy comprising, in weight %, less than 0.02% carbon; greater than 0.0 and ≦0.5% silicon; greater than 0.0 and ≦0.2% manganese; 10.0–40.0% chromium; ≦0.6% nickel; ≦0.01% copper; 2.0–10.0% aluminum; one or more of Sc, Y, La, Ce, Ti, Zr, Hf, V, Nb and Ta in an amount of 0.1–1.0; remainder iron and unavoidable impurities.

2. The alloy as defined in claim 1, wherein the content of chromium is 15–25 weight-%.

3. The alloy as defined in claim 1, wherein the content of aluminum is 3.0–8.0 weight-%.

4. The alloy as defined in claim 1, wherein the content of nickel is less than 0.1 weight-%.

5. The alloy as defined in claim 1, wherein the content of manganese is less than 0.1 weight-%.

6. The alloy as defined in claim 1, wherein the content of copper is not higher than 0.004 weight-%.

7. An electrical heating element comprising a powder metallurgical FeCrAl alloy comprising, in weight %, less than 0.02% carbon; greater than 0.0 and ≦0.5% silicon; ≦0.2% manganese; 10.0–40.0% chromium; ≦0.6% nickel; ≦0.01% copper; 2.0–10.0% aluminum; one or more of Sc, Y, La, Ce, Ti, Zr, Hf, V, Nb and Ta in an amount of 0.1–1.0; remainder iron and unavoidable impurities.

8. A diffusion furnace for the manufacture of semiconductor wafers comprising the electrical heating element according to claim 7.

* * * * *